US009375378B2

(12) United States Patent
Price

(10) Patent No.: US 9,375,378 B2
(45) Date of Patent: Jun. 28, 2016

(54) STAIR-ASSIST DEVICE

(71) Applicant: Denis D. Price, Ontario, OR (US)

(72) Inventor: Denis D. Price, Ontario, OR (US)

( * ) Notice: Subject to any disclaimer, the term of this patent is extended or adjusted under 35 U.S.C. 154(b) by 0 days.

(21) Appl. No.: 14/211,750

(22) Filed: Mar. 14, 2014

(65) Prior Publication Data

US 2014/0261587 A1 Sep. 18, 2014

Related U.S. Application Data

(60) Provisional application No. 61/784,851, filed on Mar. 14, 2013.

(51) Int. Cl.
*A61H 3/00* (2006.01)

(52) U.S. Cl.
CPC ..... *A61H 3/00* (2013.01); *A61H 2003/001* (2013.01); *A61H 2003/005* (2013.01)

(58) Field of Classification Search
CPC ..... A61H 3/00; A61H 2003/005; A61H 2003/001
USPC ..... 135/65, 66, 67
See application file for complete search history.

(56) References Cited

U.S. PATENT DOCUMENTS 2,652,097 A * 9/1953 Warren ..... 482/68
2,766,813 A * 10/1956 Kay ..... A45B 5/00 248/155.5
2,798,533 A * 7/1957 Frank ..... A61H 3/00 135/67
3,354,893 A * 11/1967 Schmerl ..... A61H 3/04 135/67
3,455,313 A * 7/1969 King ..... A61H 3/00 135/67
3,596,668 A * 8/1971 Tosto ..... A61H 3/00 135/67
3,800,815 A * 4/1974 Birk ..... A61H 3/00 135/67
4,094,331 A * 6/1978 Rozsa ..... A61H 3/00 135/67
4,867,188 A * 9/1989 Reid ..... 135/67
5,086,798 A * 2/1992 Motts ..... A61H 3/00 135/67
5,263,506 A * 11/1993 Narramore ..... A61H 3/00 135/67
5,271,422 A * 12/1993 Sorrell ..... A61H 3/04 135/66
5,603,517 A * 2/1997 Lorman ..... A61H 3/04 135/67
5,746,236 A * 5/1998 Tilsley et al. ..... 135/66
5,800,317 A * 9/1998 Accetta ..... 482/66
5,904,168 A * 5/1999 Alulyan ..... 135/65
2005/0109379 A1* 5/2005 Rader ..... 135/68
2008/0121258 A1* 5/2008 Lin ..... A61H 3/00 135/67
2009/0058037 A1* 3/2009 Accetta ..... A61G 5/00 280/267
2011/0278808 A1* 11/2011 Kline ..... 280/43

* cited by examiner

*Primary Examiner* — Noah Chandler Hawk
(74) *Attorney, Agent, or Firm* — Chernoff, Vilhauer, McClung & Stenzel, LLP

(57) ABSTRACT

A device for assisting a person to climb up or down a stairway. A pair of frame rails extend longitudinally parallel with each other and spaced apart by a distance wide enough to receive a person's knee on a leg support member suspended by the frame side rail members and a transverse front member of the frame. Front legs of the device are shorter than rear legs so that the frame side rail members are horizontal when the device is on a stairway. A stabilizer member extends above the next step above the one on which the front legs are placed, and a handle is supported above one of the side rails to support the user's weight during use of the device.

15 Claims, 9 Drawing Sheets

STAIR-ASSIST DEVICE

BACKGROUND OF THE INVENTION

The present invention relates generally to mobility aids and particularly to such a device for use in aiding a person to climb stairs and to enter or depart from a motor vehicle.

Lower leg and foot injuries or disease may require the affected foot or lower leg of a person to be protected from bearing a person's weight, although the person can still stand on the unaffected leg.

While movement is possible in a wheelchair or using devices such as the scooter disclosed in Hoepner et al. U.S. Pat. No. 7,780,180, including wheels, a handle, and a leg supporting upper surface to support an injured lower leg for a person traveling on even, level surfaces, such devices are not helpful in climbing stairs while avoiding application of weight to an injured leg or foot.

Kline U.S. Pat. No. 8,302,974 discloses a device similar to a chair, with adjustable legs which permit the device to be supported with one pair of legs on a stair step and the other pair of legs on a higher stair step. The Kline device, however, is quite wide, and appears susceptible to tipping over toward an upper stair step.

What is desired, then, is a device for aiding a person to climb stairs that is of an easily manageable size and which provides for stability in an upstairs or downstairs direction.

SUMMARY OF THE INVENTION

The present invention, as defined by the claims appended hereto, provides a device for assisting a person having an injured lower leg or foot to safely and easily climb stairs while avoiding bearing weight on the affected lower leg or foot.

In a stair-climbing assistance device which is one embodiment of the present invention a frame includes a pair of parallel side rails between which is a leg-supporting member, and the frame is supported on a pair of front legs that can rest on an upper stair step and a pair of rear legs that are longer than the front legs and can be rested on a lower stair step and support the side rails of the frame in a generally horizontal orientation.

In one embodiment a forward frame extension member extends forward from the frame above the next step above the one on which the front legs are resting.

In one embodiment a handle includes a pair of upright members, one extending upward from the forward frame extension member and the other extending upward from a side rail member of the frame, and a top rail of the handle extends longitudinally and generally horizontally between the upright members of the handle.

In one embodiment the leg supporting member is supported by and is located between front portions of the side rails, and the side rails extend rearwardly beyond the furthest rearward extent of the leg supporting member, providing a space where a person's ankle and foot can be placed.

In one embodiment of the device, the legs are adjustable in length.

The foregoing and other objectives and features of the invention will be more readily understood upon consideration of the following detailed description of the invention, taken in conjunction with the accompanying drawings.

DETAILED DESCRIPTION OF EMBODIMENTS

Figure 1:
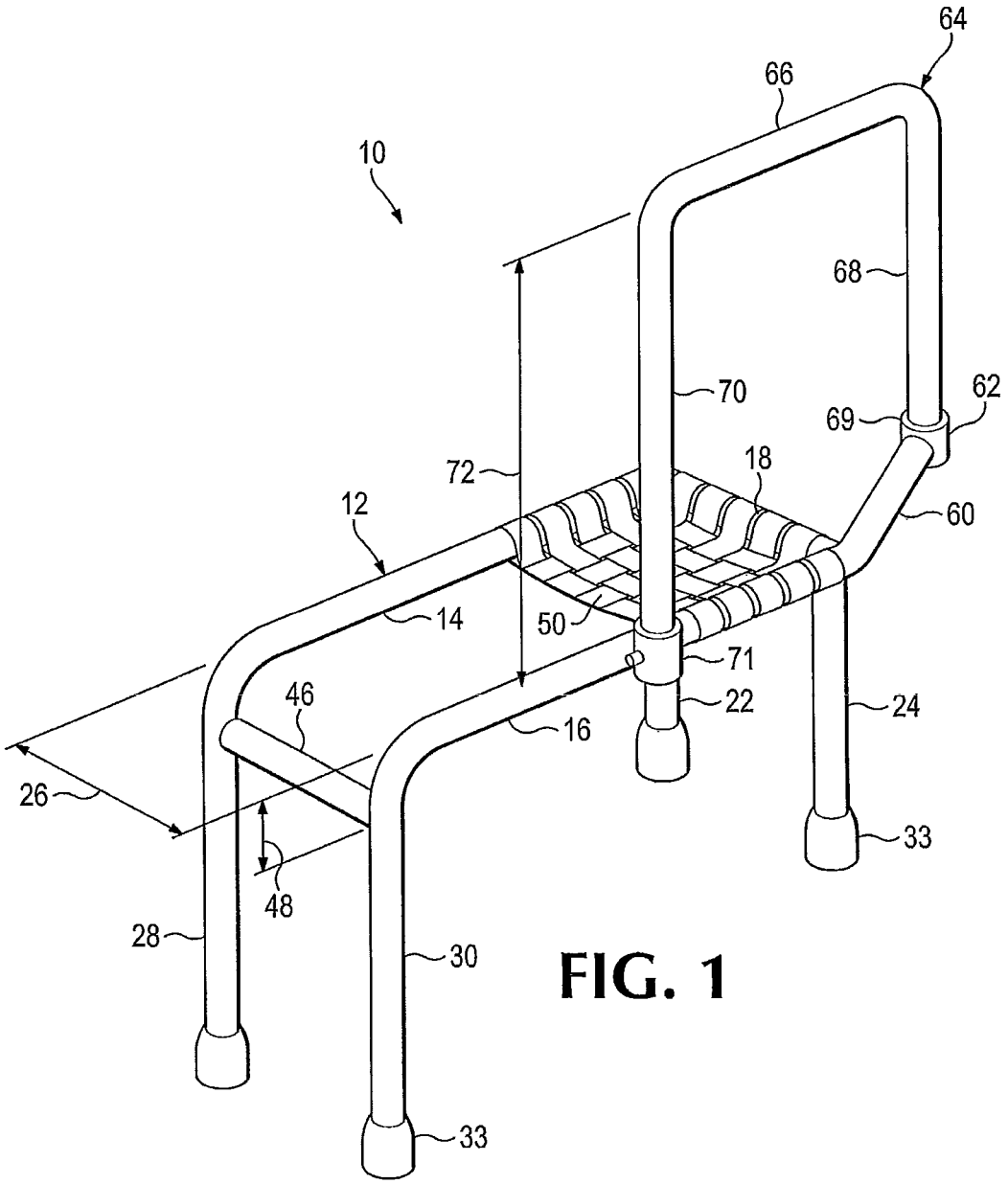
FIG. 1 is a perspective view of a device for assisting in climbing stairs which is an exemplary embodiment of the present invention.
Figure 2:
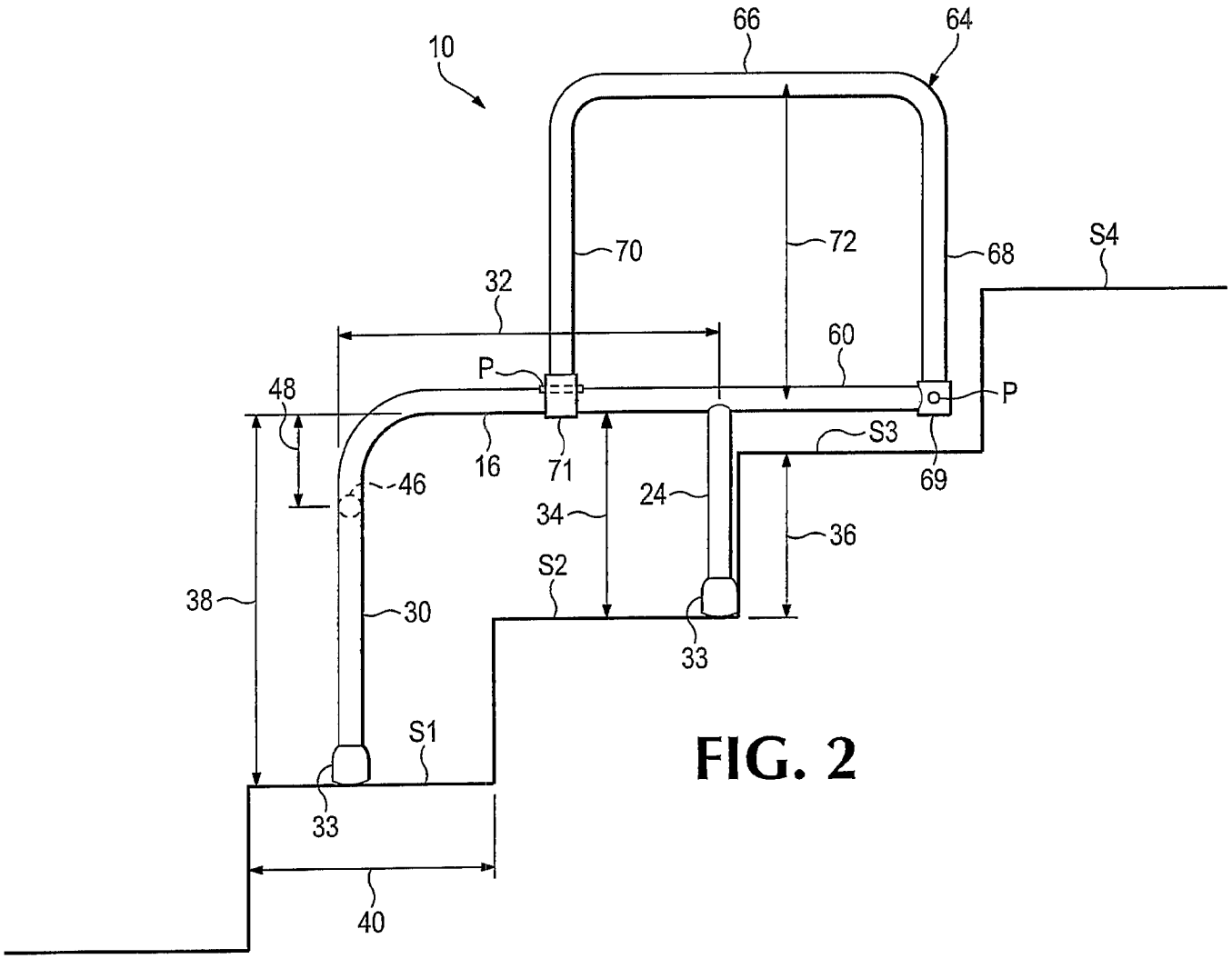
FIG. 2 is a side elevational view of the device shown in FIG. 1 in position for use on a stairway.
Figure 3:
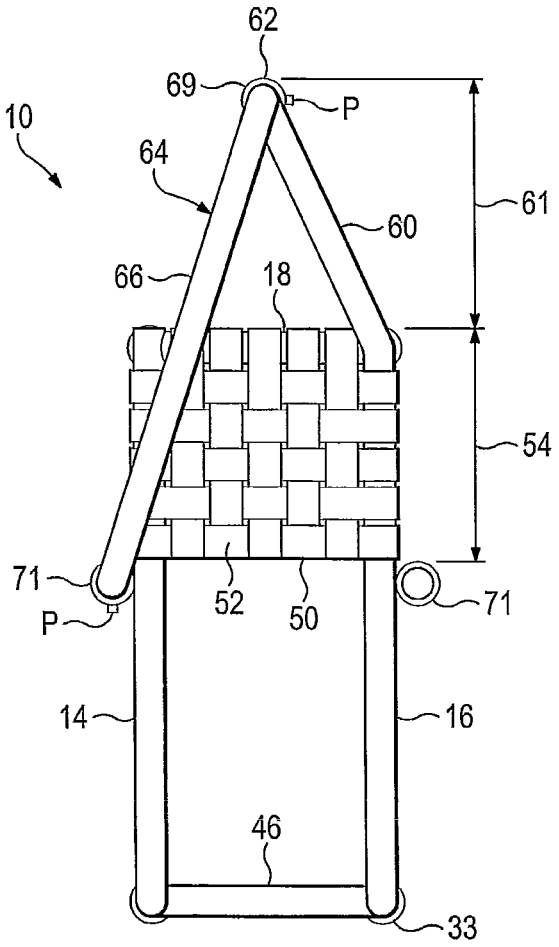
FIG. 3 is a top plan view of the device shown in FIGS. 1 and 2.

Referring first to FIGS. 1-3 of the drawings which form a part of the disclosure herein, a stair-climbing assistance device 10 has a frame 12 including a pair of parallel longitudinal horizontal members or frame rails 14 and 16 and a transverse frame member 18 interconnecting the frame rails 14 and 16 at a front end 20 of the frame 12. A pair of front legs 22 and 24 extends downwardly from the front end of the frame 12 and may be welded or otherwise securely attached to the rails 14 and 16 and to the transverse member 18. The transverse member 18 establishes a width 26 between the rails 14 and 16 of, for example, 6 inches, although a width in the range of 5 inches-8 inches between the rails 14 and 16 could also be satisfactory.

Each of the frame rails 14 and 16 may be bent at its rear end, to extend downwardly as rear legs 28 and 30 at a distance 32 behind the front legs 22 and 24. That is, the rear legs 28 and 30 may thus be respective extensions of the rails 14 and 16, with each of the rear legs 28 and 30 being connected with the respective rail 14 as by a bend in a unitary piece of material. Preferably, each leg may have a non-skid tip 33.

The front legs 22 and 24 depend below the frame rails 14 and 16 with a front leg height 34 chosen to be at least slightly greater than a stair step rise distance 36, for example, by about 1 to 2 inches.

Each rear leg 28 and 30 extends downward below the height of the frame rails 14 and 16 by a rear leg height 38 preferably equal to the front leg height 34 plus the stair step rise distance 36, so that the frame rails are horizontal when the device 10 is used for climbing a stairway. As shown in FIG. 2 the rear legs 28 and 30 are on a lower stair step S1, and the front legs 22 and 24 are on a step S2.

The rear legs 28 and 30 may be separated from the front legs 22 and 24 by a longitudinal separation distance 32 of, for example, about 16 inches, center-to-center, although a separation in the range of about 14 inches to about 18 inches would be satisfactory. Depending upon the stair step run distance 40, the rear legs 28 and 30 are spaced back from the front legs 22 and 24 by a longitudinal separation 32 great enough to establish a stable base, but not so far back as to risk the rear legs 28 and 30 slipping off the front edge of a stair step S1.

The rear legs 28 and 30 may be interconnected with each other by a transverse member 46 located at a height which is a distance 48 of, about 2 to 4 inches below the height of the longitudinal rails 14 and 16.

A leg support 50 of a flexible but at most only slightly elastic material, such as a sturdy textile fabric, extends between the frame rails 14 and 16 near the front end 20 of the frame 12. For example, the leg support 50 may be an area of webbing material 52 stretched between the frame rails 14 and 16 with lengths wrapped around each of the rails 14 and 16 and lengths of similar webbing 52 woven into the lengths of webbing extending transversely between the rails 14 and 16 and attached to the transverse member 18 at the front end 20 of the frame 12. Such webbing may, for example, be one and one-half inch wide woven cotton webbing straps. The leg support 50 may extend rearward from the front end 20 of the frame 12 over a distance of 6 to 9 inches and preferably extends rearwardly a distance 54 of about 7 inches to give room for a user's knee to rest comfortably. The leg support 50 should be able to be depressed slightly to form a shallow hollow to hold and stabilize the knee without pressure concentrations.

While it would be possible to have the leg support 50 extend along the entire length of the frame side rails 14 and 16, the shorter length 54 by which the leg support 50 extends rearward from the front end 20 of the frame 12 is desired, as it allows the user's injured or diseased leg to be placed between the rear end portions of the rails 14 and 16. This allows the user's injured leg to be bent somewhat less at its knee, while also allowing the injured foot not to be used to help support the user, and the location between the frame side rails 14 and 16 keeps the lower leg and foot properly directed.

A forward extension member 60, which may also be called a stabilizing member, extends forward from the front end 20 of the frame 12 by a distance 61 that may be about equal to the stair step run distance 40, or in the range of about 8 inches to about 11 inches, and desirably about 10 inches so that when the front legs 22 and 24 are abutted against the front edge of a stair step S3 as shown in FIG. 2, the extension member 60 will be nearly in contact with the front edge of step S4, the next step above the one against which the front legs 20 and 22 are located. As shown herein, the forward extension member 60 may be, but is not necessarily, an extension of the frame rail 14 or 16 on one side of the frame 12, and may extend diagonally toward the centerline of the frame 12. Thus the forward end 62 of the forward extension member may be located centrally ahead of the frame 12.

A handle 64 includes a top rail 66, and a first or front handle upright member 68 extends upwardly from a socket 69 mounted on the front end 62 of the extension member 60. A rear handle upright member 70 extends upwardly from a socket 71 mounted on the side rail 16 of the frame 20, generally parallel with the front handle upright member 68, while the top rail 66 portion of the handle extends generally horizontally, and is connected with a top end of each of the handle upright members 68 and 70. The front handle upright member 68, the top rail member 66, and the rear handle upright may all be formed, for example, by bending a single elongate member.

The top rail 66 of the handle 64 is located a convenient distance 72 above the side rail 16, such as, for example, being 14 inches above the rail 16 and thus about 30 inches above the stair step S1 on which the rear legs 28 and 30 are located. The handle top rail 66 is thus at a height that is convenient for a person to grasp it and apply some weight by leaning on the handle while the knee of the affected leg rests on the leg support 50.

The frame, including the frame side rail members 14 and 16, the front transverse member 18, the front legs 22 and 24, the rear legs 28 and 30, the horizontal member 46, the forward extension member 60, and the handle 64 may all be of a strong metal tubing or suitably strong composite material, preferably relatively light in weight, as the device needs to be lifted from step to step by the user. For example, 1½ inch diameter thin wall steel tubing, or aluminum tubing may be suitable materials.

The stair climbing assistance, or "stair-assist" device 10 as shown in FIGS. 1 and 2, is intended for use by a person whose lower right leg or right foot has been injured or is otherwise intended not to bear weight. The person can place the right knee on the leg support 50, with the right foot between the rearward portions of the frame rails 14 and 16, with the ankle or foot possibly resting atop the rear transverse member 46. As shown in FIG. 3 the rear upright handle member 70 is fitted into a socket 71 located on the left side frame rail 14. While the front or first handle upright member 68 as its bottom end retained in the socket 69 at the front end 62 of the extension member 60. The handle upright members 68 and 70 are secured in the sockets 69 and 71, respectively, by conventional means such as pins P extending through corresponding holes in the sockets 69 and 71 and in the handle upright members 68 and 70.

As shown in FIG. 3, the stair assist device 10 is adapted for use by a person whose left foot or lower leg is incapacitated and the left foot must be kept in a non-weight-bearing condition.

Figure 4:
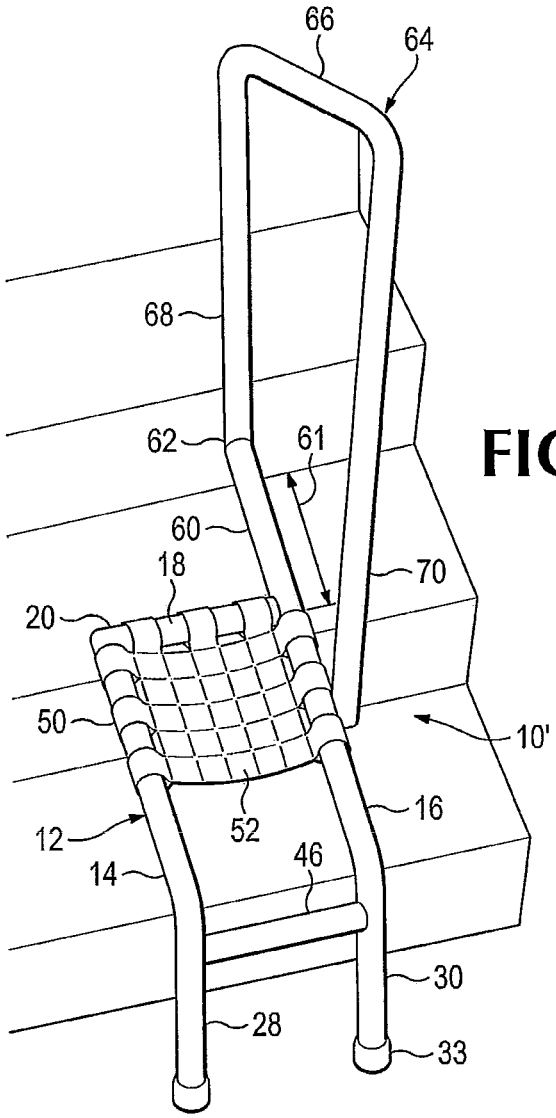
FIG. 4 is a perspective view from the rear of a device similar to the one shown in FIGS. 1 and 2, with the device in place on a stairway.
Figure 5:
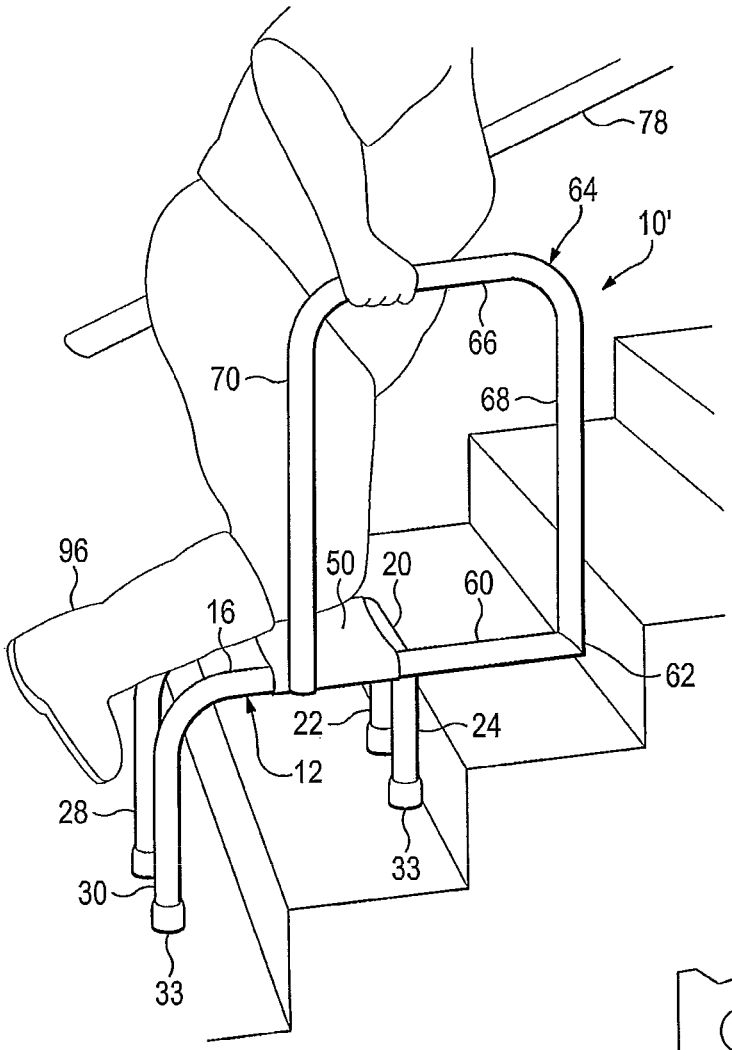
FIG. 5 is a side view of the device shown in FIG. 4 in use to climb a stairway.

A stair assist device 10' shown in FIGS. 4 and 5 is slightly different from the stair assist device 10 shown in FIGS. 1-3, in that the forward extension member 60' extends straight forward as a continuation of the right side frame rail member 16, and the handle upright members 68 and 70 are welded, respectively, to the front end 62 of the extension member 60' and to the side rail 16 on the right side of the frame 12. The stair-assist device 10', then, is not convertible for use by a person whose left foot has been injured. The person can stand on his or her "good" leg as the person uses his or her right hand to raise the stair assist device 10' and move it to the next higher stair step. The front extension and the front handle upright 68 provide a good visual reference for placement of the stair assist device 10' in a stable location, in which the front legs 22 and 24 will be adjacent to the riser of the next higher step and the rear legs 28 and 30 will rest securely on the tread of the next lower step.

While the stair-assist device 10' illustrated in FIGS. 4-5 is best suited for a person whose right foot or lower leg is injured or diseased, a mirror-image, opposite-sided version of the device 10' (not shown) would be used by a person whose left foot or lower leg has been affected.

Where a stairway railing 78 is available on at least one side of the stairway, as shown in FIG. 4, a person can use his or her left hand to grasp the stairway railing 78 while the right hand is to move the stair assist-device 10 or 10' so that the "good" leg can be raised to the next higher stair step in climbing up the stairs. The top rail 66 of the handle is available to be grasped to aid in steadying the person when the knee is supported on the leg support 50. In descending a stairway using the stair-assist device 10 or 10' the user would support his or her weight on the device 10 or 10' by resting the knee of the injured leg on the leg support member 50 while moving the "good" foot down a step. The user would then lift the stair-assist device 10 or 10' by the handle and move it down a step while standing on the "good" leg.

The position of the forward extension member, or stabilizing member, 60 or 60' a small distance above or resting nearly on the tread of the next higher step, step S3 as seen in FIG. 2, assures that the stair-assist device 10 or 10' cannot tip over forward. This also supports the handle top rail 66 where it is secure and stable, instilling confidence in the user that the stair-assist device 10 or 10' can be relied upon to maintain the user's balance while climbing or descending a stairway.

Figure 6:
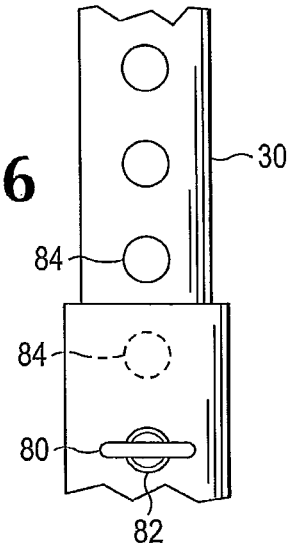
FIG. 6 is a detail view of an adjustable leg of the device shown in FIGS. 1-5.

The legs of the stair-assist device 10 can be made adjustable in length by incorporating a mechanism such as that shown in FIG. 6, using a pin 80 and a set of matching holes 82 and 84 spaced along tubular leg parts that fit inside one another, to set the legs so as to fit a particular staircase most appropriately and thus maintain a horizontal orientation of the frame 12. Thus the front legs 20 and 22 can be adjusted in length to support the frame 12 so that the forward extension member 60 is located close above the tread of the next higher stair step S3. Similarly, the rear legs 28 and 30 can be adjusted in length to support the frame 12 with its side rails 14 and 16 horizontal when the feet of the rear legs 28 and 30 rest on the next lower stair step S1.

Depending on the user's height and the stair step rise distance 36 it may be desirable for the front legs 22 and 24 and the rear legs 28 and 30 to be adjusted to respective greater heights, to result in the leg support 50 being at a height that is most comfortable for the user.

The stair-assist device 10 or 10' can also be used to assist a person climb into or out of a motor vehicle, particularly one of appreciable height, such as a sport utility vehicle, as shown best in FIGS. 7A, 7B, 7C, and 7D.

Figure 7A:
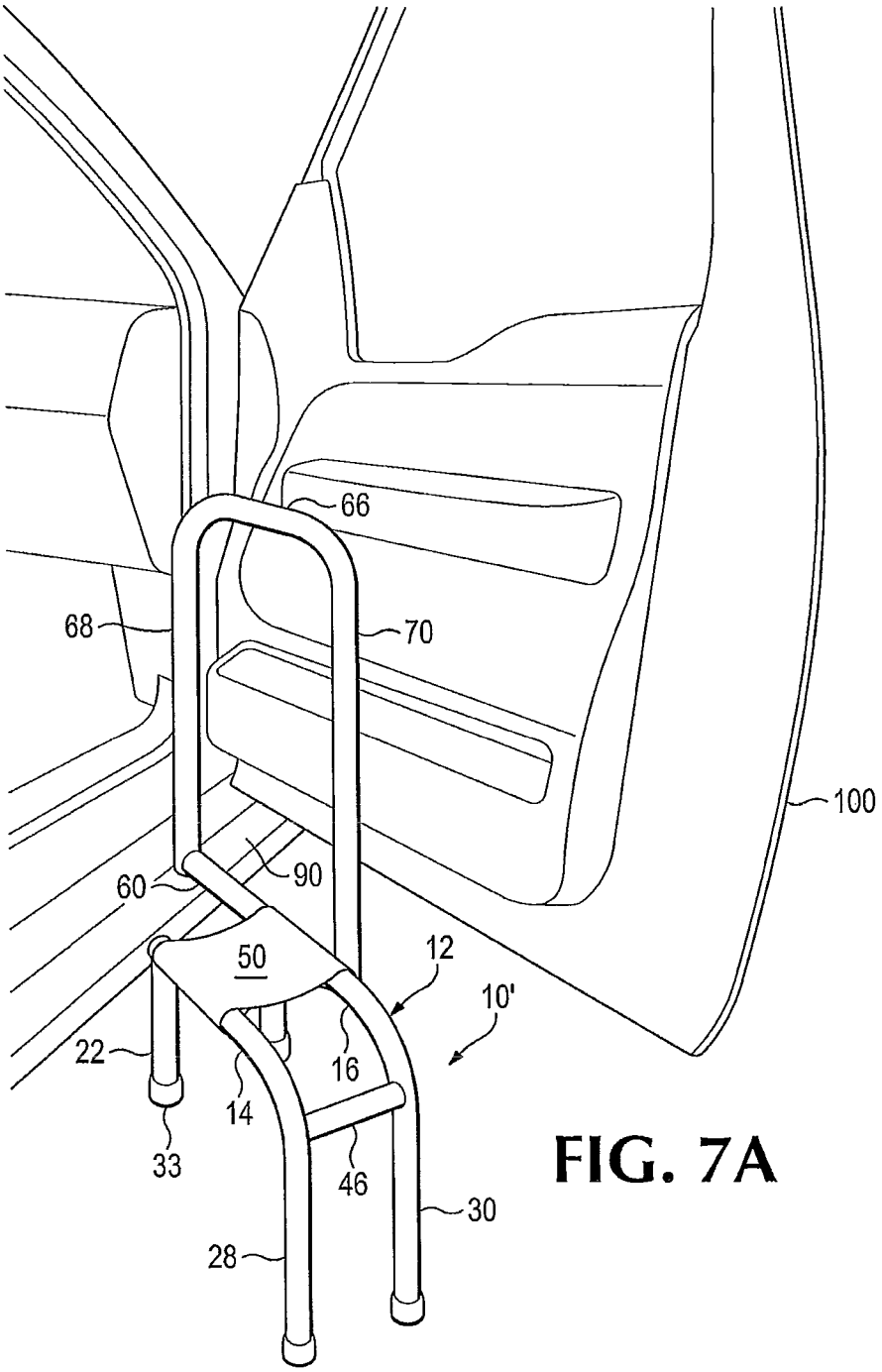
FIG. 7A-7D are perspective views of the device shown in FIGS. 4 and 5, showing its use in assisting a person to enter an automobile.

In FIG. 7A the stair-assist device 10' is shown with its rear legs 28 and 30 on the ground beside a motor vehicle 88 such as an SUV with a running board 90, and the forward extension or stabilizing member 60' is resting atop the running board 90, holding the frame 12 with its side rail members 14 and 16 approximately horizontal. Depending upon the height of the running board, the length of the rear legs 28 and 30 with the stair-assist device 10' adjusted for a stairway may be satisfactory, or the rear legs 28 and 30 may have to be adjusted in length to fit and accommodate the height of the door sill or running board 90 of a particular motor vehicle 88 and hold the frame side rails 14 and 16 in a horizontal orientation.

Figure 7B:
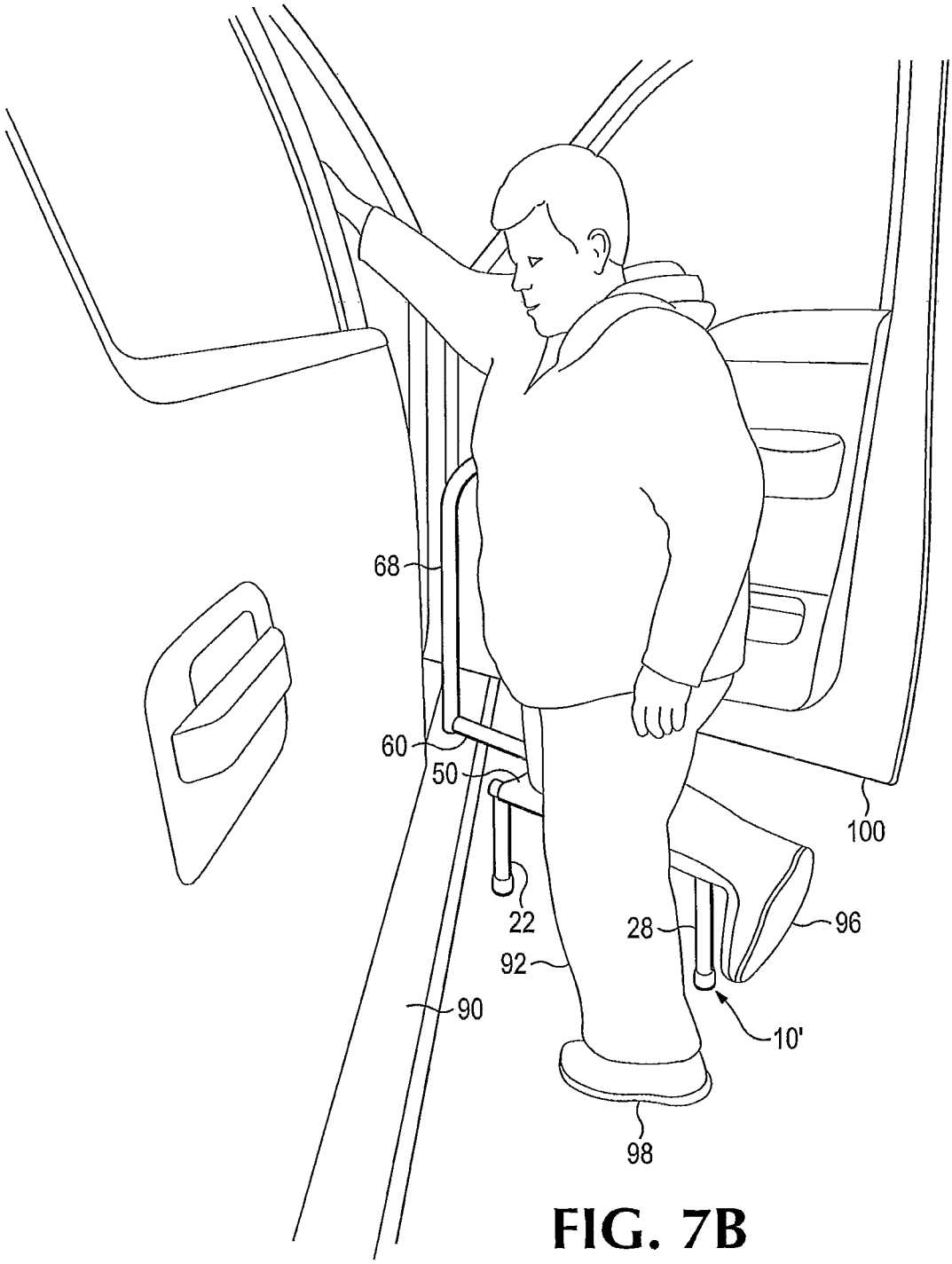

As shown in FIG. 7B, to enter the motor vehicle 88, the person can stand on the "good" left leg 92 alongside stair-assist device 10' and place his or her right knee 94 on the leg support member 50 while facing the interior of the vehicle, and with an affected foot 96, extending rearward.

Figure 7C:
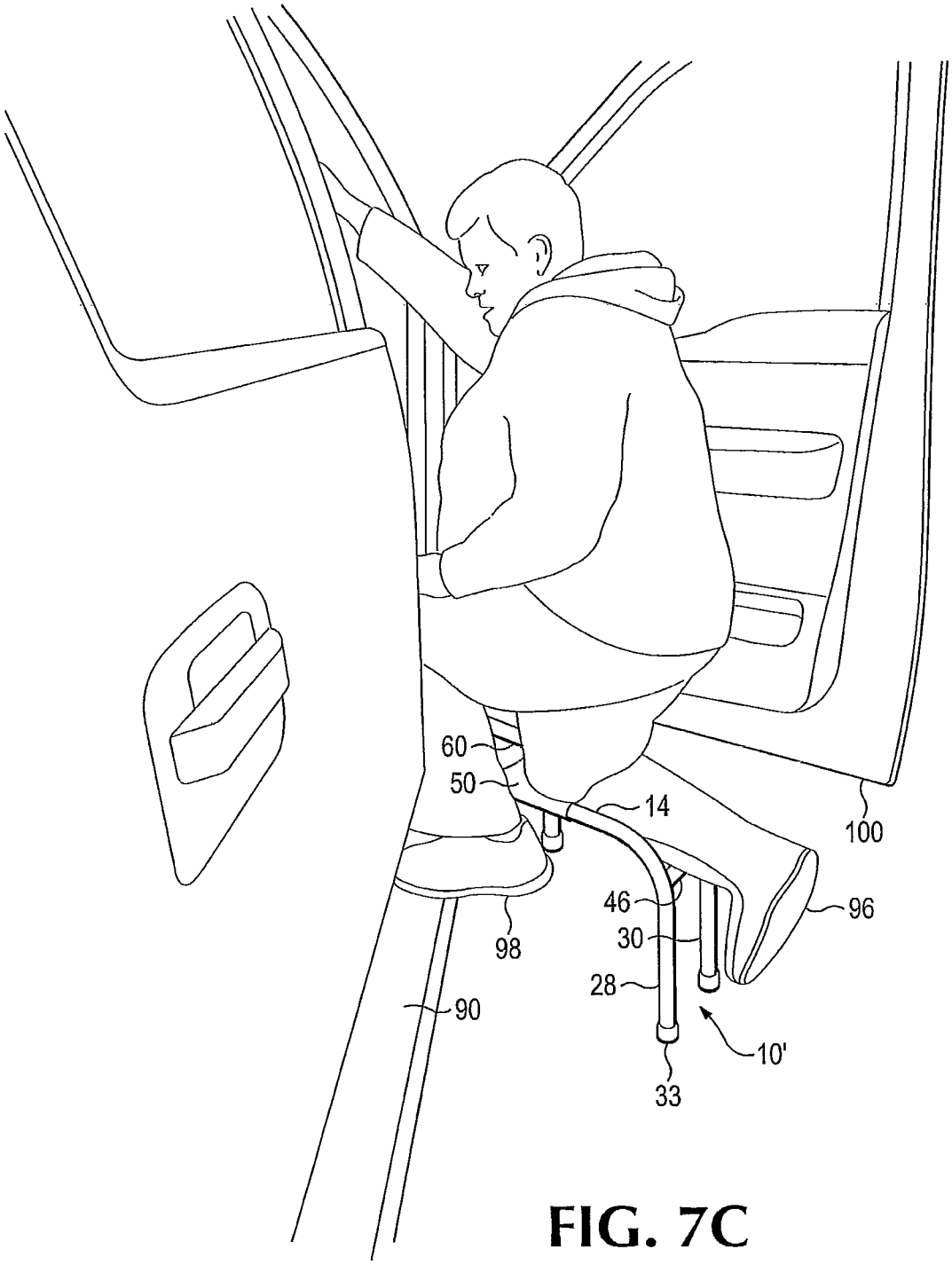
Figure 7D:
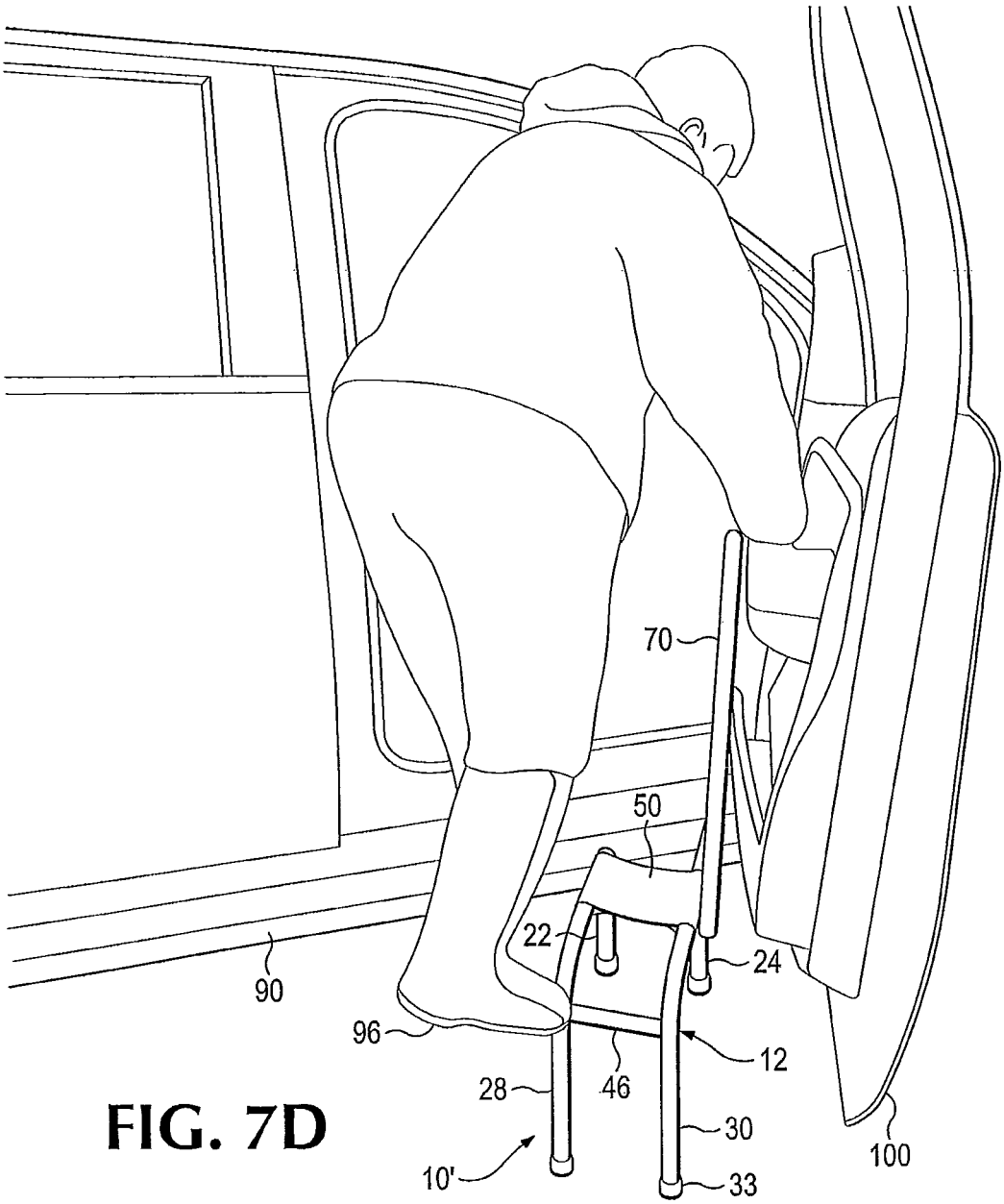

Referring to FIG. 7C, while grasping the doorway frame or a suitable and convenient part of the interior structure of the motor vehicle, the user can place her weight on the knee 94 on the leg support 50 of the stair-assist device 10' and raise the "good" foot 98 to the running board 90 at the doorway of the motor vehicle. Then, as shown in FIG. 7D, the person can rise with his or her weight on the "good" leg 92 and on the handle top rail 66 or on the adjacent door 100 of the motor vehicle and turn to sit on the seat of the motor vehicle.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A device for assisting a person in climbing stairs having a step rise height and a step run, the device comprising:

(a) a generally horizontal frame having a pair of lateral sides, each having a respective one of a pair of frame side rails, and having a transversely-extending front end member interconnecting the frame side rails;

(b) a pair of front legs each connected with and extending downwardly from a front part of a respective one of the frame side rails and each having a front leg height and a respective foot;

(c) a pair of rear legs, each connected with and extending downwardly from a respective one of the frame side rails, the rear legs being independent from the front legs and separated from the front legs by a distance equal to between 1 and 2 times the step run of each of the steps of the stairs, and each rear leg having a rear leg height that is greater than the front leg height;

(d) a forward extension member of the frame extending horizontally forward from the frame beyond the front end member;

(e) a handle connected with the frame and including a top rail portion spaced upwardly above the frame and associated with only a single selected side of the frame; and (f) a leg support attached to the frame, at a convenient height for a person using the device to place the person's lower leg thereon, and extending rearward from the front end member of the frame a selected distance that is less than the distance between the front legs and the rear legs.

2. The device of claim 1 wherein said leg support extends rearward from the front end member of the frame a distance in the range of 6 inches to 9 inches.

3. The device of claim 1 wherein said frame side rails extend rearward beyond said leg support member and wherein said frame side rails are spaced apart laterally from each other and define a leg receiving space located rearwardly from said leg support member.

4. The device of claim 1 wherein said forward extension member extends beyond said front legs a distance in the range of 8 inches to 11 inches.

5. The device of claim 4 wherein said forward extension member is aligned with and extends forward from one of said frame side rails.

6. The device of claim 1 wherein said handle includes a front upright member extending upward from said forward extension member.

7. The device of claim 6 wherein the forward extension member extends forward from one of the frame side rails and said handle also includes a rear upright member extending upward from the one of the frame side rails from which said forward extension member extends forward, the front and rear upright members of the handle being connected respectively to opposite front and rear ends of the top rail portion of the handle.

8. The device of claim 1 wherein said leg support is of a flexible sling-like construction defining a depression for receiving a user's knee between said side rails of said frame.

9. The device of claim 1 wherein the forward extension member is oriented coplanar with the frame side rails.

10. The device of claim 9 wherein the forward extension member extends diagonally forward from one of the frame side rails and has a forward end located centrally ahead of the frame.

11. The device of claim 1 wherein each of the rear legs extends downwardly from a respective one of the frame side rails a distance greater, by a distance about equal to the step rise height, than a distance by which each of the front legs extends downwardly from a respective one of the frame side rails.

12. The device of claim 1 wherein each of the rear legs has a respective foot.

13. The device of claim 1 wherein the forward extension member extends diagonally forward from one of the frame side rails and has a forward end located centrally ahead of the frame.

14. The device of claim 13 including a socket on the forward extension member adapted to receive a front upright member of the handle.

15. The device of claim 1 wherein the leg support is attached to the side rails of the frame.

* * * * *